US005195447A

United States Patent [19]

Jones

[11] Patent Number: 5,195,447

[45] Date of Patent: Mar. 23, 1993

[54] PERSONAL WATER CRAFT RACE STARTING DEVICE

[76] Inventor: Joseph C. Jones, P.O. Box 2292, Coeur d'Alene, Id. 83814

[21] Appl. No.: 929,785

[22] Filed: Aug. 13, 1992

[51] Int. Cl.[5] ..... B63B 35/00

[52] U.S. Cl. ..... 114/270; 239/390; 244/63

[58] Field of Search ..... 244/114 B, 63; 239/265.19, 265.27, 390, 391; 114/248, 270, 343; 440/40–42, 38, 113

[56] References Cited

U.S. PATENT DOCUMENTS 2,674,335 4/1954 Lemmerman ..... 244/114 B
4,699,596 10/1987 Klinker ..... 441/71
5,140,922 8/1992 Bowman et al. ..... 114/270

FOREIGN PATENT DOCUMENTS 0077397 3/1990 Japan ..... 244/114 B

*Primary Examiner*—Edwin L. Swinehart

*Attorney, Agent, or Firm*—Wells, St. John, Roberts, Gregory & Matkin

[57] ABSTRACT

A race starting device for personal watercraft includes a thrust diverter connectable to the watercraft comprising a tube having an intake end adapted for alignment with the discharge nozzle of the watercraft, and a discharge end that is displaced from the intake end by a bent section of the tube to divert water flow from the water craft and thereby inhibit forward propulsion thereof until released. The diverter has the effect of deflecting the thrust from the watercraft and thereby inhibiting its forward propulsion. A quick release mechanism is also provided to releasably secure the thrust diverter to the watercraft. The release mechanism may be controlled by the watercraft operator to selectively release the device and allow the watercraft to thrust forwardly, leaving the starting device behind. Groups of the thrust diverters and quick release mechanisms may be provided on common frames for group starts. In one, a single quick release mechanism is provided to simultaneously start several racers.

20 Claims, 10 Drawing Sheets

PERSONAL WATER CRAFT RACE STARTING DEVICE

TECHNICAL FIELD

The present invention relates to attachments to personal watercraft and more particularly to a releasable race starting device.

BACKGROUND OF THE INVENTION

Personal watercraft are steadily gaining in popularity. Along with the increased popularity of such craft, there is a rising interest in racing such craft. In racing personal watercraft, it is typical that two individuals are required, the rider, and another person to hold the watercraft in place until the start of the race. The "holder" is used to allow the racer to advance the throttle of the watercraft so he or she may quickly accelerate from the starting line. This requires considerable strength and balance from the holder, and it is very frequent that false starts occur when the holder is unable to prevent the watercraft from moving ahead of the starting line before the official race start.

Additionally, it is uncomfortable for the holder to stand in the path of the thrust. An additional problem with the two person start arrangement is the margin for human error. With two individuals involved in the racing start for each racer, the possibility for error and false starts is quite substantial.

A need has therefore developed for some form of starting apparatus that will facilitate racing starts and eliminate the need for a second person to hold the personal watercraft.

BRIEF DESCRIPTION OF THE DRAWINGS

Preferred embodiments of the present invention are illustrated in the accompanying drawings in which:

FIG. 4 is an enlarged cross-sectional view taken substantially along line 4—4 in FIG. 2;

FIG. 7 is a perspective view of a second preferred embodiment of the present invention;

FIG. 14 is a view showing the second embodiment on a personal watercraft and a user in a starting position thereon;

FIG. 16 is a view showing a plurality of thrust diverters and releases mounted to a common starting frame, with a single operator for the quick releases.

DETAILED DESCRIPTION OF THE PREFERRED EMBODIMENTS

Figure 2:
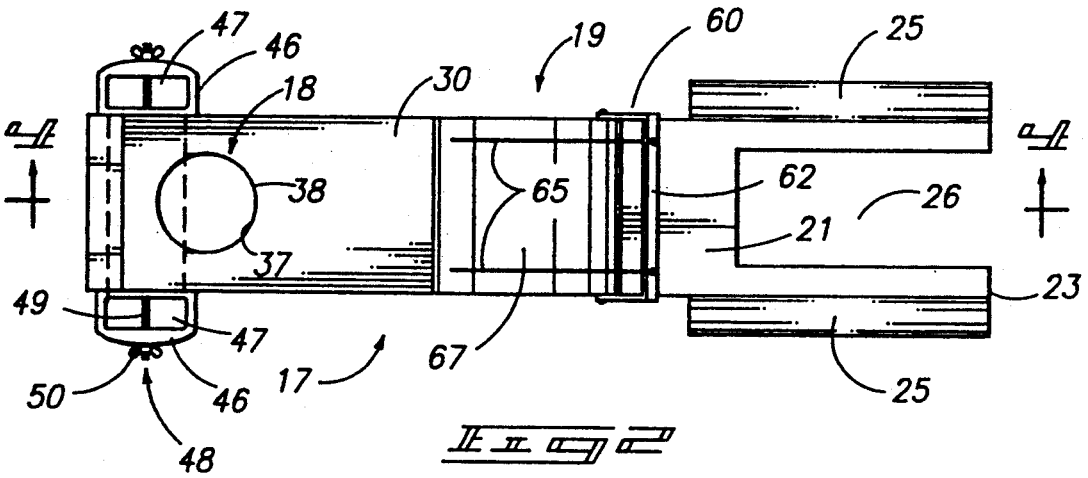
FIG. 2 is a top plan view thereof.
Figure 1:
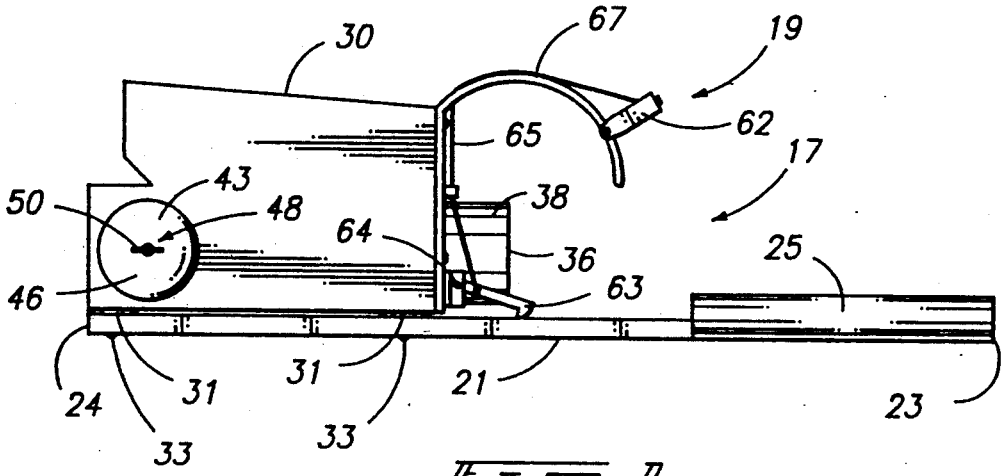
FIG. 1 is a side elevation view of a first preferred form of the present invention.
Figure 3:
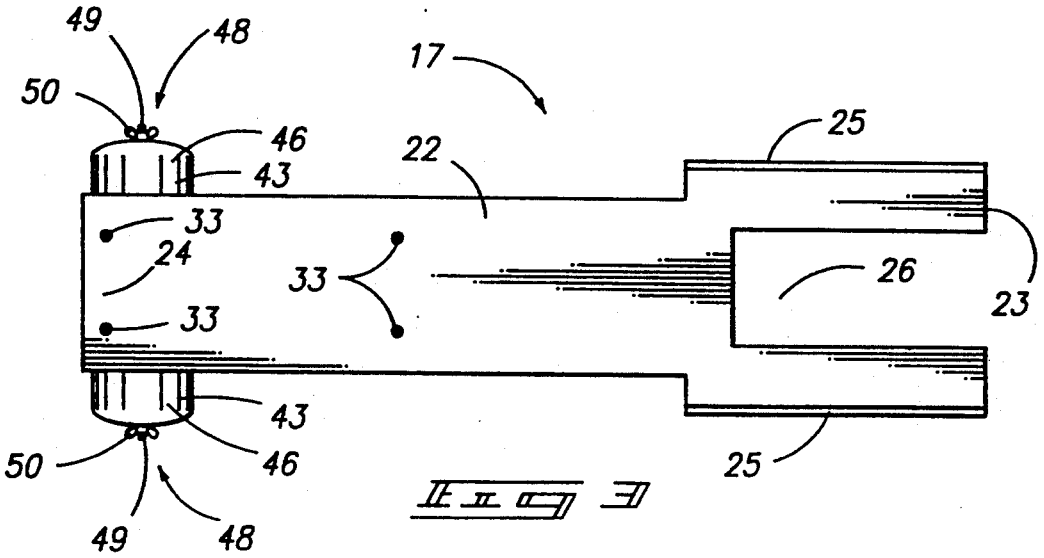
FIG. 3 is a bottom plan view.
Figure 2:
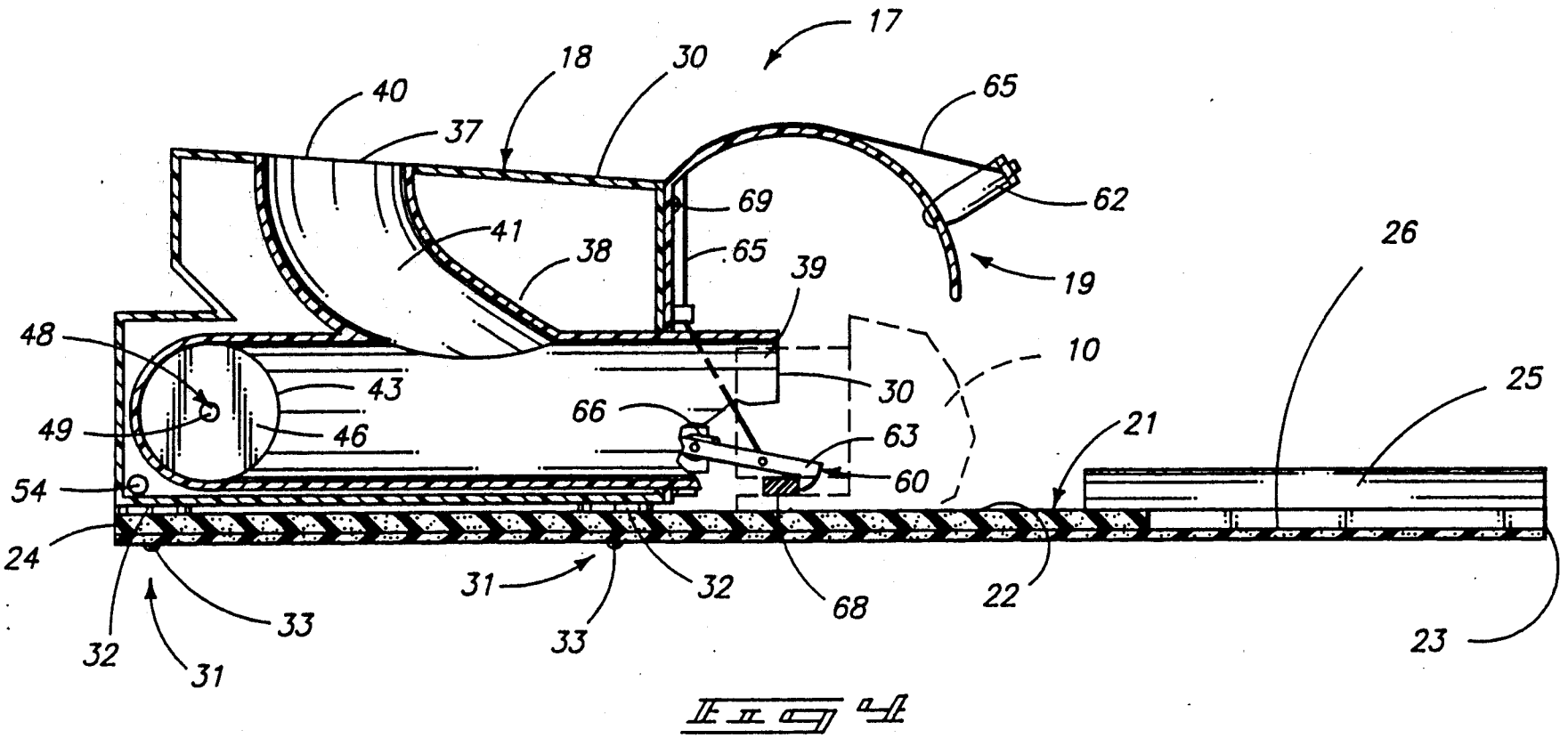
Figure 5:
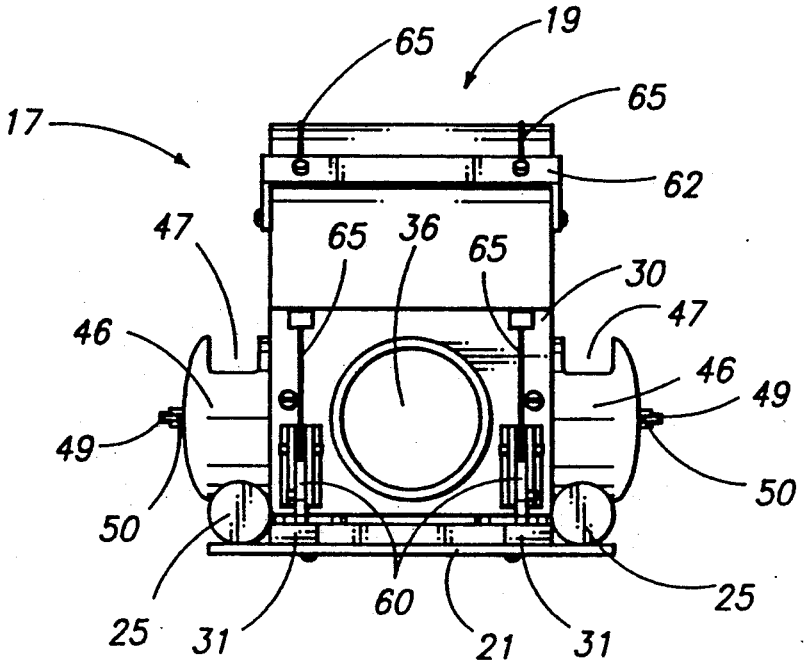
FIG. 5 is a front end view.
Figure 6:
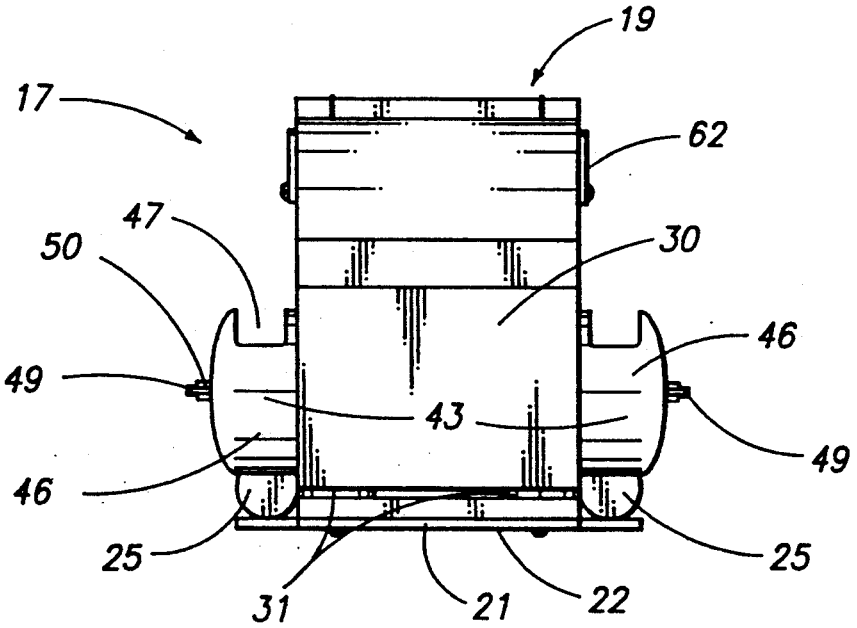
FIG. 6 is a rearward end view thereof.
Figure 11:
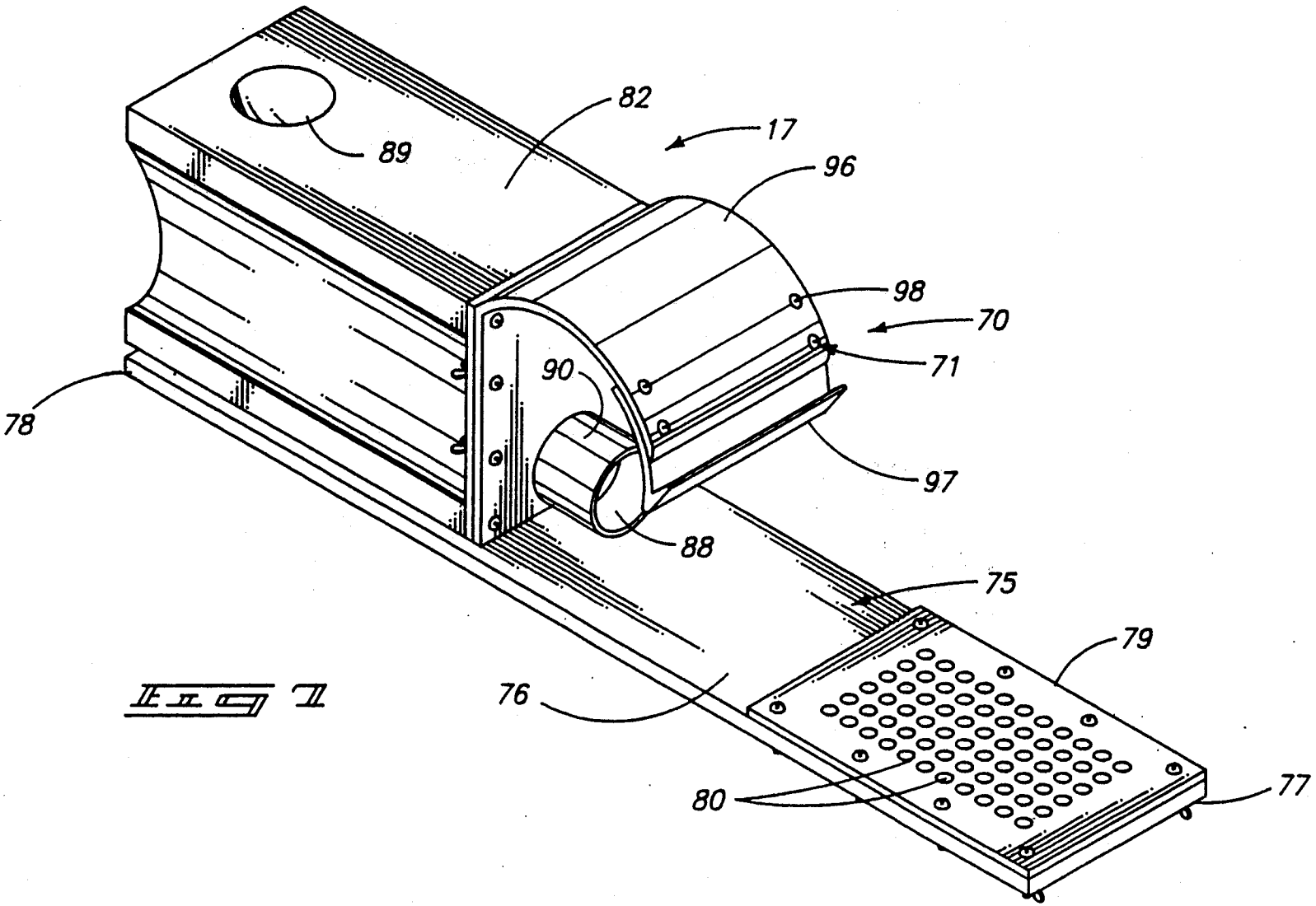
FIG. 11 is an enlarged cross-sectional view of the second embodiment, taken along line 11—11 in FIG. 8.
Figure 8:
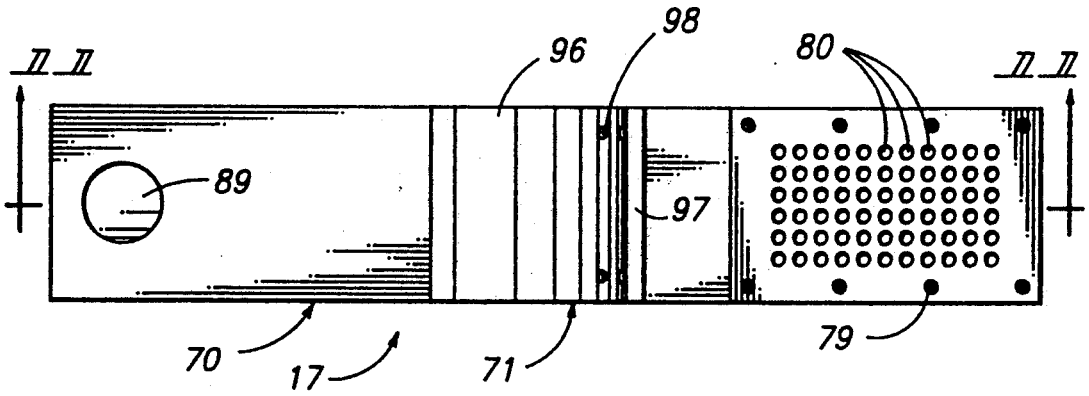
FIG. 8 is a top plan view of the second embodiment.
Figure 9:
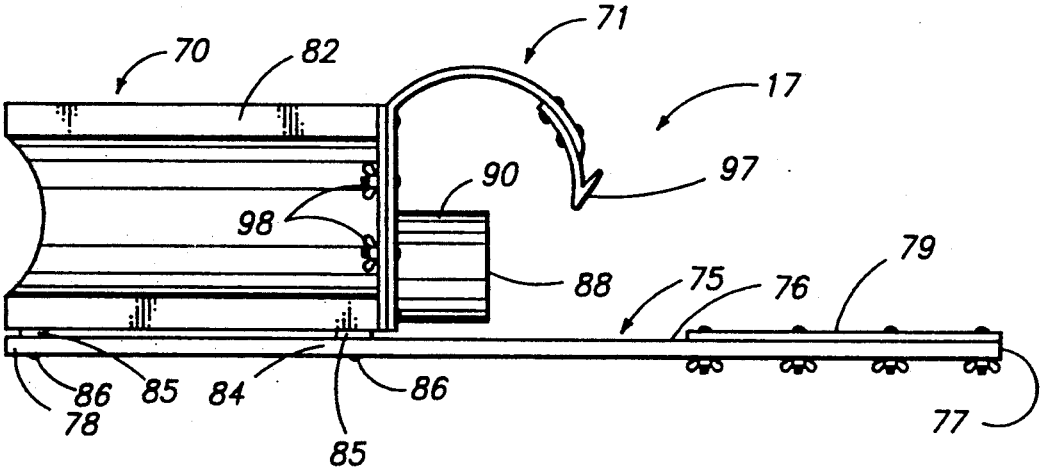
FIG. 9 is a side elevation view of the second embodiment.
Figure 10:
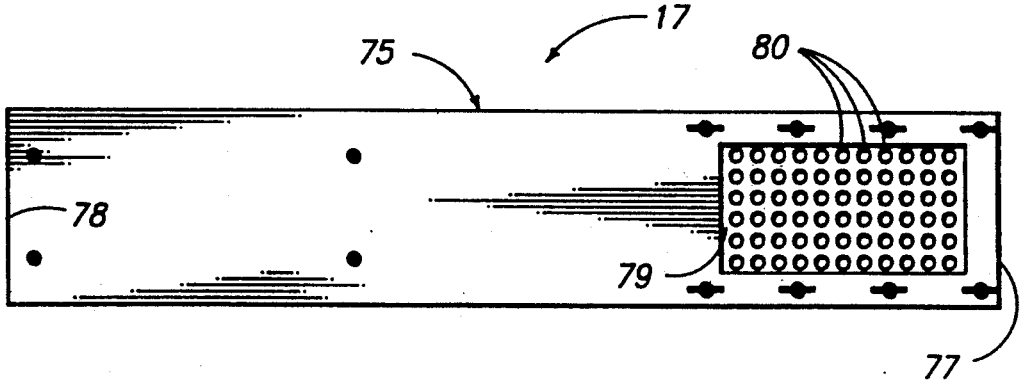
FIG. 10 is a bottom plan view of the second embodiment.
Figure 11:
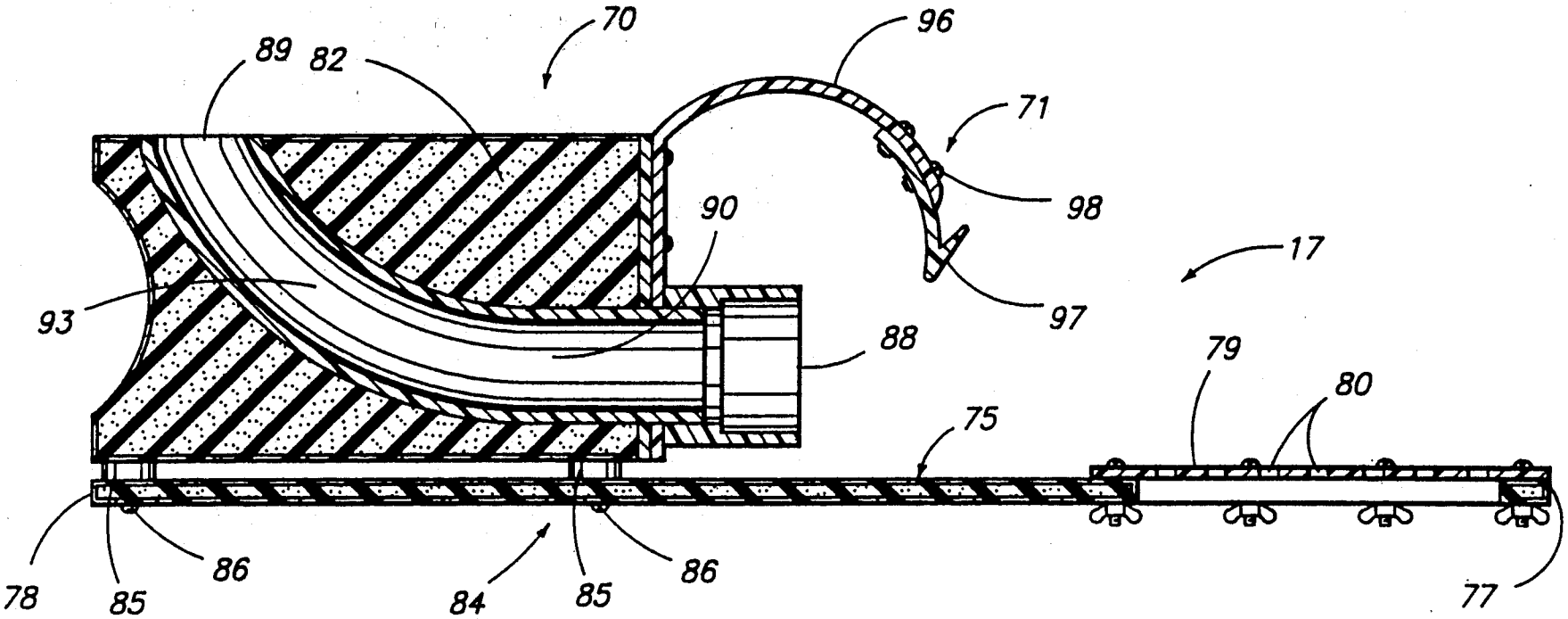
Figure 12:
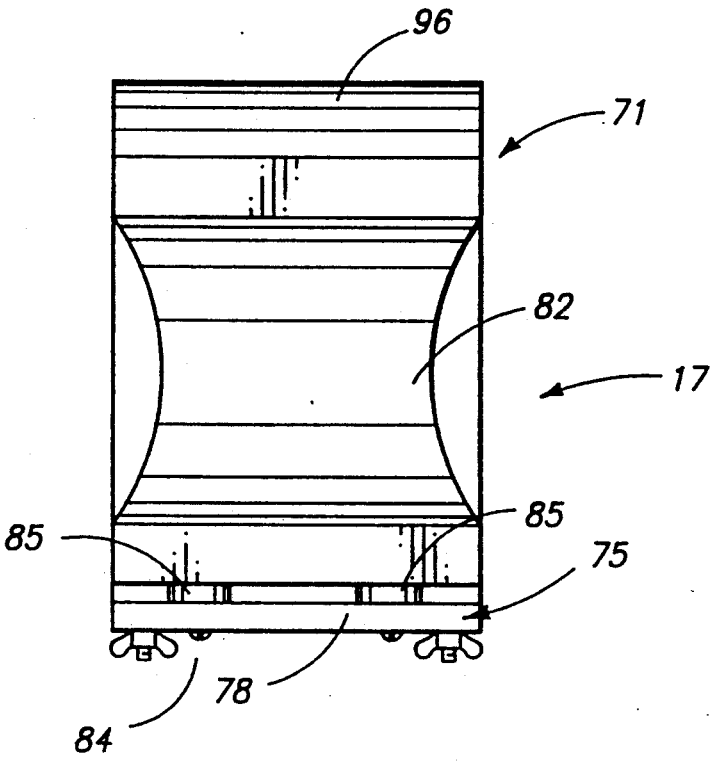
FIG. 12 is a rearward end view of the second embodiment.
Figure 13:
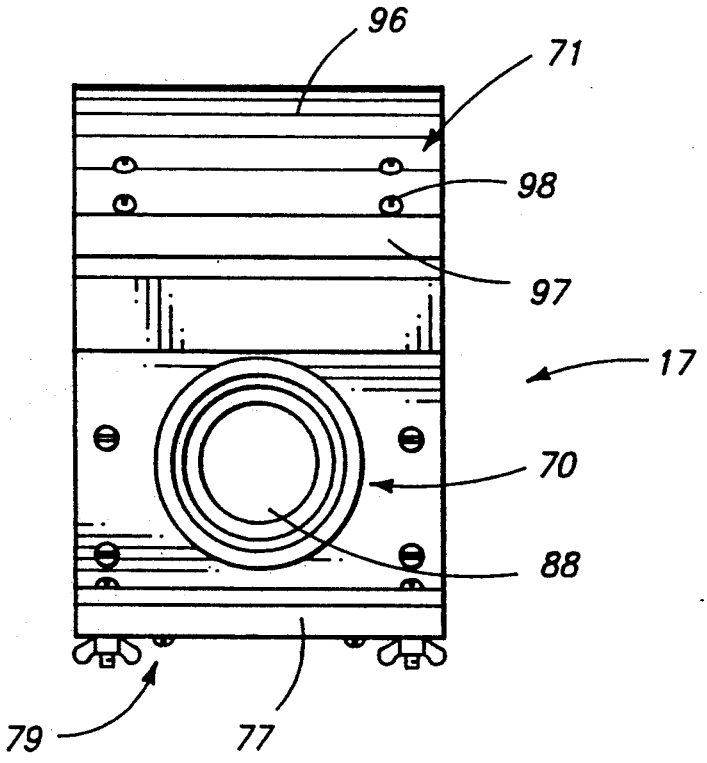
FIG. 13 is a front end view of the second embodiment.
Figure 11:
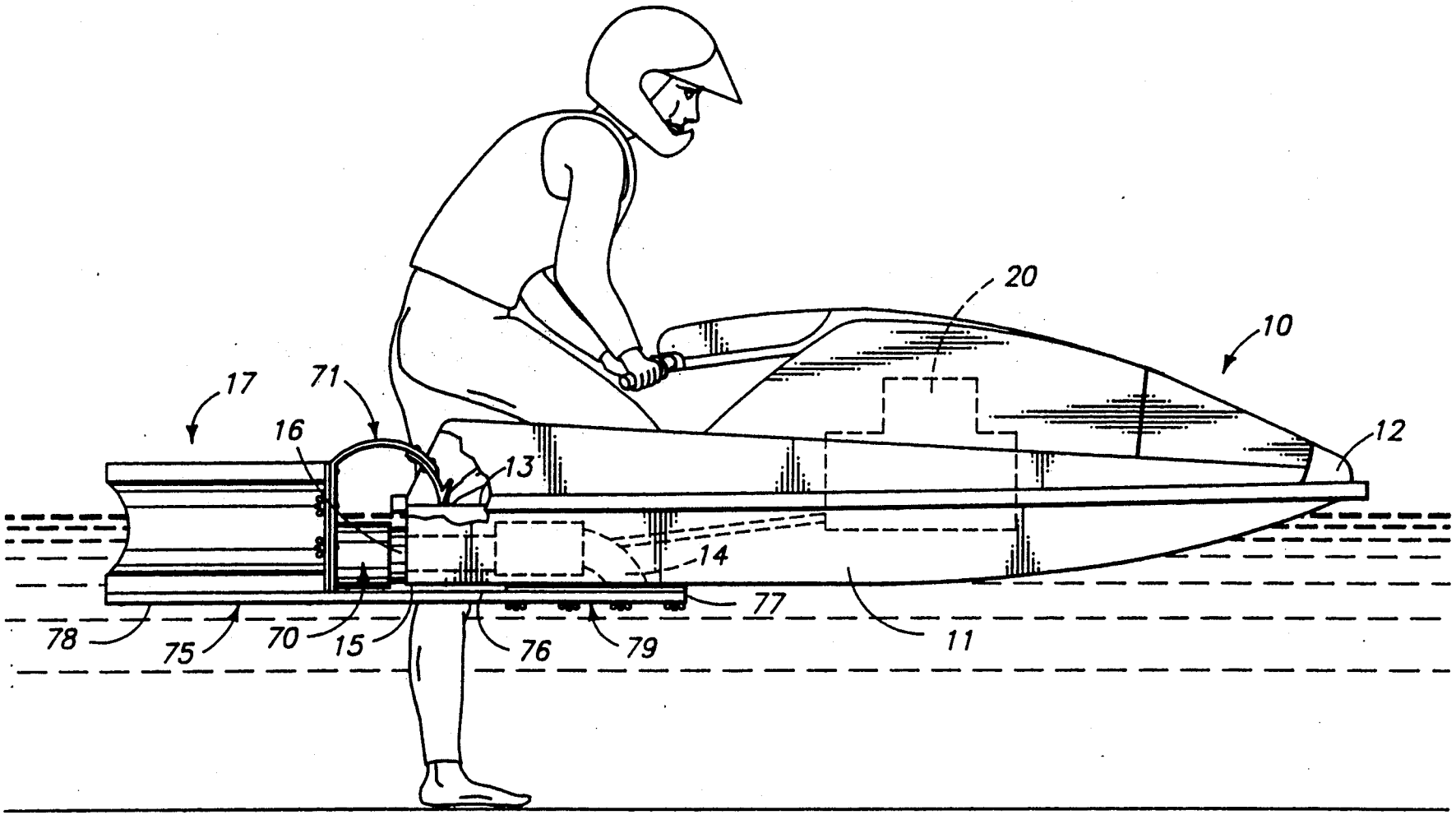

This disclosure of the invention is submitted in furtherance of the constitutional purposes of the U.S. Patent Laws "to promote the progress of science and useful arts" (Article 1, Section 8).

The present invention is provided for releasable attachment to personal watercraft of the type generally shown at 10 in FIG. 14. The watercraft 10, for purposes of description of the present invention, includes an elongated hull 11. The hull 11 includes a front or bow end 12. A user support tray or platform 13 is situated rearwardly of the bow.

The user support platform or tray 13 extends to a rear or transom end 15 of the watercraft. A jet drive discharge nozzle 16 is situated at the transom end 15 for directing the rearwardly directed jet stream of water. The water is discharged under high pressure responsive to an internal jet drive shown by dashed lines in general at 20. Water is received through an intake shown in dashed line at 14 situated along the hull 11 between the transom 15 and bow 12 and is delivered through the driven pumping unit to the discharge jet nozzle 16.

The present starting device, generally designated at 17 includes essentially two basic components, a thrust diverter and a quick release means. The thrust diverter is utilized to receive and redirect the stream of water from the jet drive discharge and thereby inhibit forward propulsion of the associated personal watercraft. The quick release means is provided to secure the thrust diverter to the personal watercraft, and for selective operation by the watercraft operator to release the thrust diverter and allow the personal watercraft to thrust ahead, leaving the starting device behind.

Figure 15:
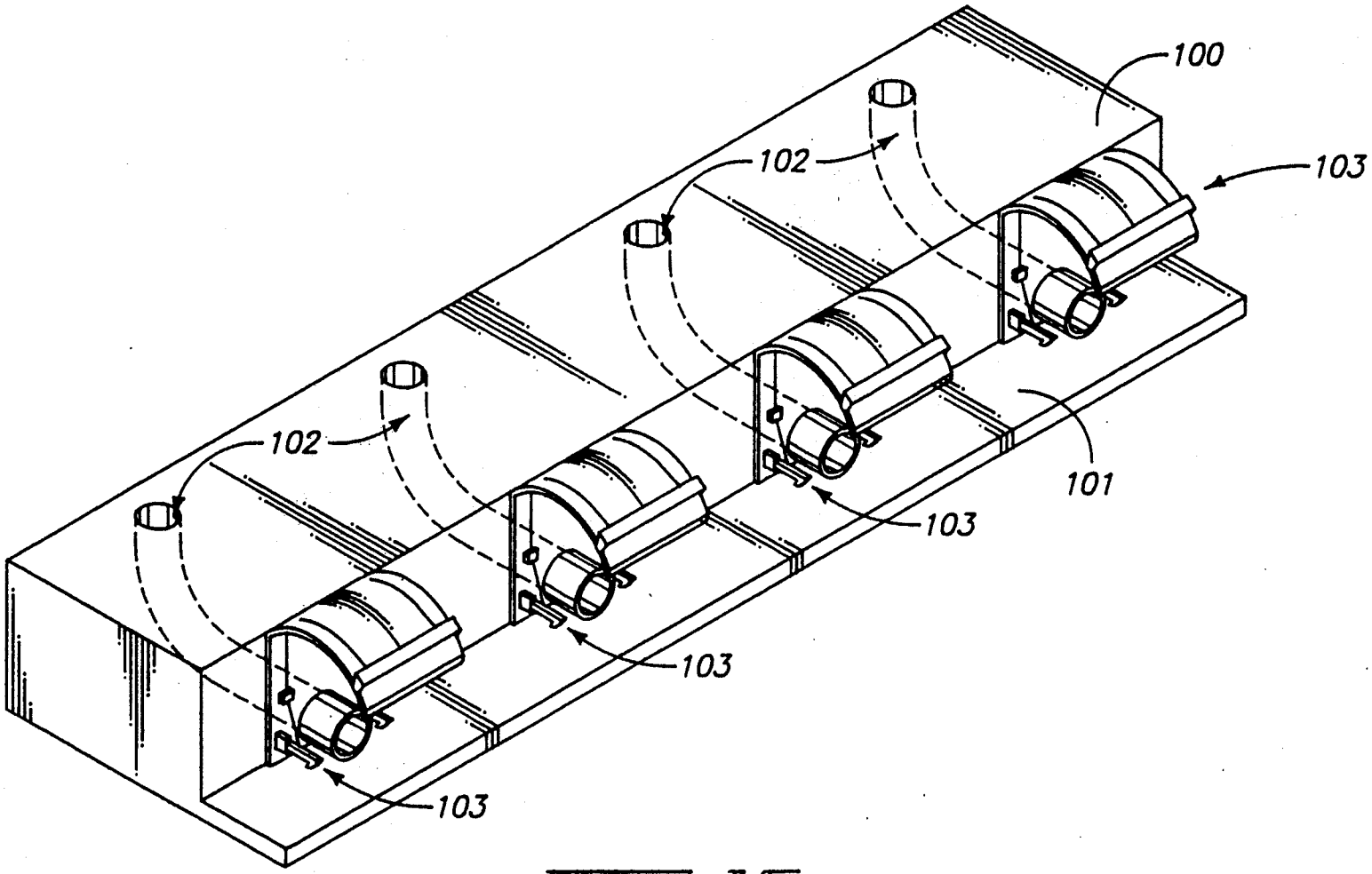
FIG. 15 is a view showing a plurality of thrust diverters and releases mounted to a common starting frame.
Figure 11:
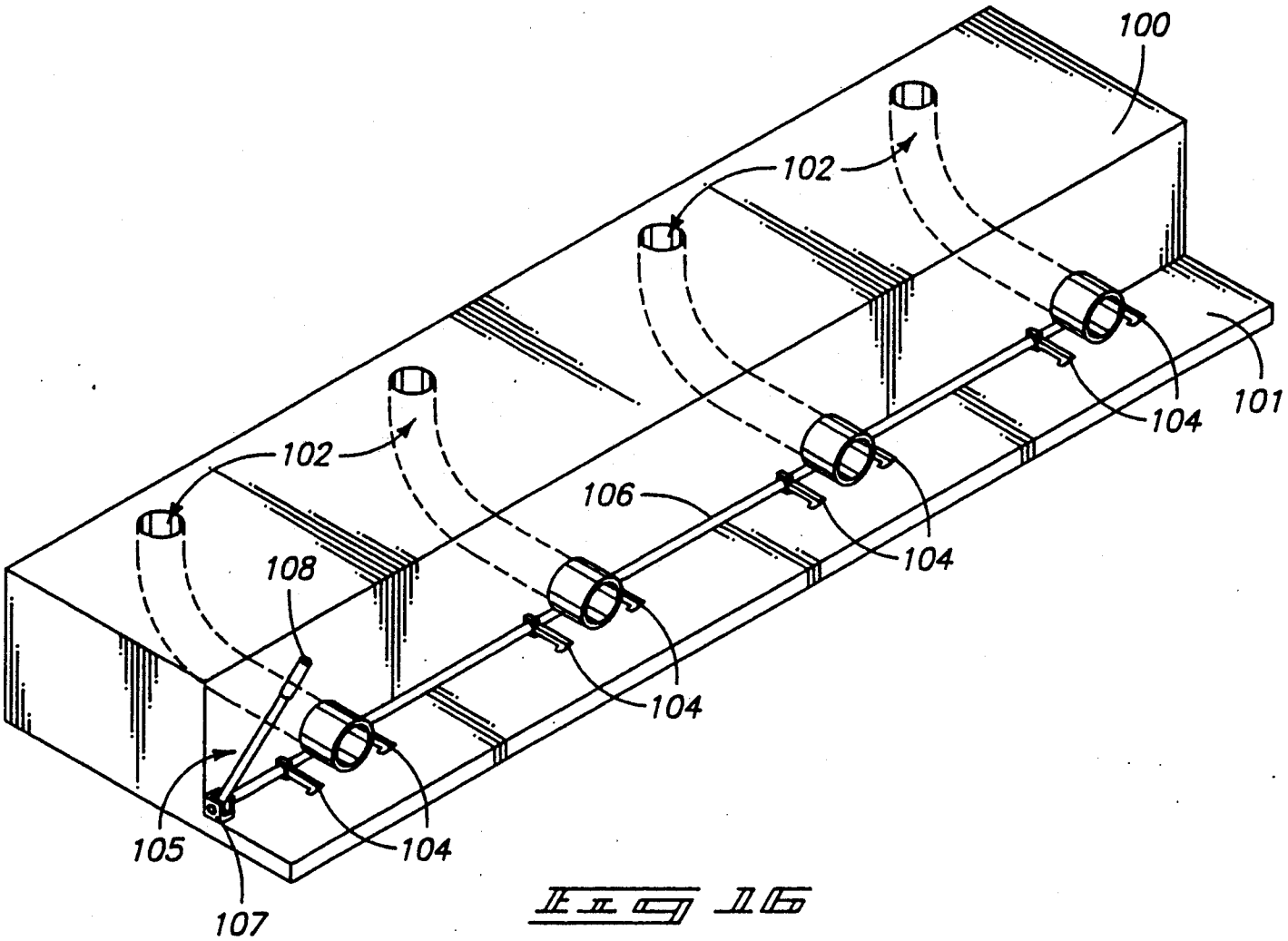

Exemplary preferred forms of the present starting device 17 are illustrated in the accompanying drawings. A first preferred embodiment is illustrated in FIGS. 1–6, while a second preferred embodiment is illustrated in FIGS. 7–14. FIGS. 15 and 16 exemplify forms of the present starting device mounted in groups for group starts. Description will first be given with respect to the first preferred embodiment.

The first embodiment of the present invention advantageously includes a thrust diverter 18 and a quick release 19. These components are advantageously mounted to an elongated frame 21. Frame 21 includes a flat platform 22 extending from a front end 23 to a rearward end 24. Platform 22 includes a width dimension that is approximately equivalent to the width dimension of a personal watercraft at the rearward hull area thereof. The platform front end 23, includes a recess 26. The recess is situated to allow free water flow into the personal watercraft water intake 14.

In the first preferred example shown, flotation 25 is provided along the sides of the platform near the front end 23. The flotation 25, provided in the form of pontoons, is used to assist initial mounting of the device 17 to the watercraft and to help hold the device in place during attachment to the watercraft. Flotation 25 also prevents the device from sinking after use.

The thrust diverter 18 is, in the preferred forms, mounted within a housing 30 on frame 21. The housing 30 of the first preferred form is preferably hollow and is not buoyant. In fact, it may be desirable to allow this housing to partially fill with water and thereby provide mass against which the thrust of the personal watercraft will operate during fast starts. This mass will provide a stabilizing affect on the unit and will aid in resisting rearward thrusting or "throwing" of the device during fast starts.

A means 31 is provided for mounting the housing 30 and thrust diverter 18 to the frame 21. Means 31 facilitates upward or downward adjustment of the thrust diverter 18 with respect to the frame 21 to accommodate personal watercraft having varying dimension from the hull 11 to the jet drive discharge nozzle 16.

In the first preferred embodiment, means 31 is comprised of spacers or washers 32 mounted between the housing 30 and frame platform 22 by removable mounting bolts 33. Washers may be added to or removed from the mounting bolts in order to vary the spacing from the platform 22 to the thrust diverter nozzle 16.

The thrust diverter 18 extends from an intake end 36 to a discharge end 37. The intake end is adapted, for example by the housing and mounting means described above, to be positioned to receive at least a portion of the stream of water from the discharge nozzle 16 of the personal watercraft. The thrust diverter also extends to a discharge end 37 that is angularly offset with respect to the intake end to deflect or divert the water stream from the jet nozzle 16 and thereby redirect the propulsion forces of the watercraft.

The thrust diverter is simply comprised of a tube 38 which, in the first preferred form, is trifurcated. It extends from its intake end 36 to branch into an upturned bent section 42 and two substantially horizontal side sections 43. The upwardly bent section 42 is used to intercept and deflect the stream of water in an upwardly direction, while the side sections 43 function to receive and deflect water to opposed lateral sides of the stream discharged from the discharge nozzle 16.

The side sections 43 are advantageously covered by discharge angular adjustment means in the forms of caps 43 covering the discharge openings of the side sections 43. The caps 46 may be selectively adjusted to position their discharge openings 47 to cause upward, forward or rearward deflection of the water received by the side sections 43.

The caps 46 are releasably mounted to the side sections 43 to facilitate removal if it is desired to operate the device with the side sections 43 completely open. To this end, the caps 46 are mounted by a shaft 49 that extends through the side sections. Wing nuts 50 are threadably engaged at opposed ends of the shaft 49 against the caps 46 to selectively secure the caps in place over the openings of the side sections 43. Wing nuts 50 may be selectively loosened to permit angular adjustment of the discharge openings 47 about the axis of the shaft, and tightened to secure the caps in the adjusted positions.

The quick release means 19 is shown, in the first preferred configuration, as a latch means 60. The latch means is positioned on the thrust diverter and is connectable to the personal watercraft. It is selectively movable between an open position wherein the watercraft is disengaged from the device, and a latch position wherein the thrust diverter is attached to the personal watercraft against the rearward thrust applied by the jet drive 20.

FIG. 4 illustrates a first preferred latch means 60. In this example, means is provided at 61, for biasing the latch means 60 to the latched or closed position, to be opened by a foot operated actuator 62. The biasing means 61 may simply be comprised of conventional torsion springs 66 mounted on pivots 64 and positioned between the pivots and clamp members 63 to bias the clamp members to downward, latching positions as shown in FIG. 4.

Slidable cords 65 extend from the clamp members 63 to a foot operated actuator bar 62. The bar 62 is mounted to a curved flange 67 that is adapted to extend over the user support tray 13 for access by the user's foot in substantially the same as indicated in FIG. 14 for the second preferred form. The cords 65 extend through appropriate holes in the flange and slide freely therein.

An adjustment 69 may be provided on the curved flange 67 to facilitate upward or downward positioning of the latch means to accommodate different watercraft configurations.

The user's toes may be used to force the actuator 62 downwardly. The downwardly moving actuator will pull the cords 65 and consequently lift the clamp members 63. This action will allow the clamp members to release a catch 68 (FIG. 4). The catch 68 is secured to the transom of the personal watercraft.

Once the latch is opened, the thrust from the watercraft will separate the thrust diverter from the watercraft and allow the watercraft to start forwardly.

The catch or dog 68 is simply a block or bar secured by standard fasteners or adhesives to the rearward projecting portion of the watercraft hull. The catch or dog 68 may thus remain on the watercraft at all times.

Operation of the first preferred form of the present invention is initiated by mounting the device to the personal watercraft. This is done simply by sliding the device into place with the forward frame section extending along the rearward underside surface of the hull 11 and positioning the intake end 36 of the thrust diverter in rearward alignment with the jet nozzle of the watercraft.

The device is moved forwardly in the aligned orientation until the clamps 63 snap over and grip the catch member 68 on the transom of the watercraft. The clamps 63 will cam over the catch member 68 automatically snap into place by provision of the biasing spring 66. The clamps will not release until positive motion of the foot operated actuator 62.

The user may then position himself on the watercraft substantially as shown in FIG. 14 for the second preferred form. He or she will place his foot adjacent to the foot operated actuator 62 and, at the instant of the start, will thrust the foot downwardly to move the operator actuator down. This will release the clamps 63 and allow the forward thrust of the jet drive to push the watercraft away from the diverter.

During the time immediately prior to the start, the user is able to increase the throttle on the watercraft to obtain the benefit of a nearly full throttle, instantaneous start. The thrust from the watercraft which would otherwise drive the craft and user forwardly, is diverted by the thrust diverter 18 and, since the device is clamped to the watercraft, no forward propulsion is experienced. The user is therefore able to stand next to the craft and hold it in a steady staging position ready for start, with the throttle nearly open. Then, once the user disengages the device, the watercraft will rocket forwardly, in a fast, positive start.

The second embodiment of the present race starting device 17, as indicated above, is shown in FIGS. 7–14. This embodiment includes a thrust diverter 70 and quick release mechanism 71 exemplifying variations from the thrust diverter and quick release mechanism described above.

This form includes an elongated frame 75 and platform 76 extending between a front end 77 and rear end 78. The front end of the frame includes an intake restrictor plate 79. Selectively sized apertures 80 are provided in the plate to control the amount of water allowed to be received through the personal watercraft intake 14. By so restricting the amount of water intake, the suction developed may be used to somewhat secure the device to the watercraft.

The apertured restrictor plate is removable by means of standard releasable fasteners to facilitate adjust of the aperture size and number in order to facilitate adjustment for different watercraft.

Housing 82 mounts the thrust diverter 70. The housing 82 is provided with flotation (FIG. 11), thereby either supplementing or eliminating the need for the flotation pontoons 25 shown for the first preferred embodiment.

The housing 82 and thrust diverter 70 are mounted to the frame by means 84 substantially identical to the mounting means 31 described for the first embodiment. Thus, the means 84 may include appropriate spacers or washers 85 and bolts 86 securing the washers between the frame and housing.

The thrust diverter 70 extends from an intake end 88 to a discharge end 89. It is comprised of a single tube 90 having a forward opening 91 at the first end and a second end opening 92 that is oriented rearwardly and opening in an upward direction as clearly shown in FIG. 11. The tube thus includes a bent section 93 between the ends 88 and 89, used to deflect water received from the discharge nozzle of the personal watercraft in an upward direction.

The quick release mechanism 71 in the second preferred embodiment is comprised of a arched spring member 96 with a toe release flange 97 at a forward end thereof. The spring member 96 is provided with adjustment assemblies 98 to facilitate elevational adjustment between the toe release 97 and the frame platform 76.

The distance is adjustable between the toe release 97 and the frame platform 76 in order to adjust the clamping pressure applied by the spring member 96. This may be done as a matter of personal preference by the user, or to accommodate personal watercraft of different dimension between the user support tray 13 and the hull 11 immediately below.

The second embodiment of the device may be placed substantially as shown by FIG. 14 on the personal watercraft with the discharge nozzle of the jet drive situated to direct water into the intake end 88 of the thrust diverter. In this position, the spring member 96 clamps the device to the watercraft between the toe release 97 and the platform 76 of the frame.

Clamping pressure is sufficient to hold the device in place, along with the slight suctioning clamping force provided by the intake restrictor plate 79 which will, when the watercraft is running, be held by suction against the intake 14 along the watercraft hull.

To release the device, the user simply pushes rearward and upwardly with his or her toe to release the quick release mechanism, and slide the restrictor plate along with the remainder of the device rearwardly from the watercraft. This frees the watercraft from the device and lets it thrust forwardly.

Operation of the second preferred form of the present invention is initiated first by mounting the device to the personal watercraft. This is done simply by sliding the device into place with the frame forward section extending along the rearward underside surface of the hull 11 and positioning the intake end in rearward alignment with the jet nozzle of the watercraft.

The device is moved forwardly in the aligned orientation until the spring clamp member 96 clamps the device to the watercraft between the toe release 97 and the platform 76 of the frame. At this point, the intake restrictor plate 79 will also be positioned adjacent the water craft intake 14, and be releasably held in place by suction. If adjusted properly, the clamp member 96 and intake restrictor will not release the device from the craft until positive action by the user, even with the water craft drive at nearly full throttle.

The user may assume a position along side the watercraft substantially as shown in FIG. 14. He or she will place his foot adjacent to the toe release 97 and, when it is desired to start, will thrust the foot rearwardly and upwardly to disengage the clamp and restrictor plate and allow the forward thrust of the jet drive to push the watercraft away from the device. Once the user disengages the device, the watercraft will rocket forwardly, in a fast, positive start.

It is significant to the user that the device in either of the above described examples is provided to stabilize the thrust and will not result in misalignment of the watercraft during the start. This is due to the orientation of the diverted water streams. The various discharges are all oriented so the discharged water streams will not have the effect of turning the water craft from an intended starting direction. This is a distinct advantage, especially in races in which numerous racers are participating and starting from a common start line.

It should be noted that both preferred embodiments described above shown are individual units, for use with single water craft. However, it is entirely possible that several of the present devices may be joined together in appropriately spaced relation, for example by securing several of the present devices to a single elongated horizontal frame member, thereby providing a unitary starting apparatus with a fixed starting "line" determined by the several commonly mounted devices.

Exemplary arrangements of a plurality of present thrust diverters and quick releases are shown in FIGS. 15 and 16. Each unit shown is provided to facilitate controlled, even start for groups of personal water craft, as in racing conditions.

FIG. 15 shows a plurality of thrust diverters and quick releases mounted to a common group starting frame 100. The group starting frame 100 is elongated and is advantageously buoyant, if not supported by or provided as a part of another structure such as a boat, dock, pier, float, or platform. The frame 100 mounts the thrust diverters in a race starting alignment configuration, with space between successive diverters to allow for the racers to stand astride their personal water crafts. A platform 101 is provided to support the racers, and to lend support for the transoms of the water craft to be started.

Thrust diverters and quick release means 102, 103 are provided in the version shown in FIG. 15 for each individual racer's use. The form of release 103 may be as exemplified above for the first preferred form (FIGS. 1–6), and, as such will not be described in repetitious detail. It is sufficient to note that each individual racer using the multiple start arrangement of FIG. 15 will have the same toe release control as with the first preferred form described above.

The group starter example illustrated in FIG. 16 includes the same frame 100, platform 101, and thrust diverters 102, but uses a gang release mechanism 105 that is provided to operate all releases simultaneously. To this end, each release clamp member 104 is rigidly connected to a common control rod 106 for pivotal movement responsive to rotation of the rod 106.

The clamp members 104 are substantially identical, except for their common rigid connection to the rod 106, to the individual clamp members 63 shown in FIG. 4. The clamp members 104 will thus readily receive catch members 68 (FIG. 4) mounted to water craft.

The rod 106 is journalled by bearing blocks, one of which is shown in FIG. 16 at 107. An actuator lever 108 is provided at one end of the rod 106, permitting a single individual to operate all clamp members 104 as a unit. Thus a single "starter" may initiate a race in a fashion similar to the start of race horses in a "starting gate".

Operation of the multiple starting arrangement shown in FIG. 15 is essentially identical to that already described above for the first preferred form. Each racer will control his or her own start from a common starting "line".

Operation of the starting version exemplified by FIG. 16, differs from the other starting arrangements in that the start is initiated by actuation of the lever 108. The lever 108 can be operated by a starter official so all racers will begin at the same instant. The lever 108 is held in one position, as shown in FIG. 16, to hold the craft (via catch blocks or dogs 68) to the starter, while the thrust from their drive units is diverted. Then, at the selected time, the "starter" throws the lever 108 rearwardly, lifting the clamp members 104 all in unison to start the race.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A race starting device for personal water craft having a hull, a user support tray, a jet drive with a water intake on the hull, and a substantially horizontal rearward discharge nozzle for directing a stream of water in a rearward thrusting direction at a transom end of the hull, comprising:

a thrust diverter having an intake end and a discharge end, the intake end adapted to be positioned to receive at least a portion of the stream of water thrust from the discharge nozzle of the personal water craft, and the discharge end being angularly oriented with respect to the intake end to divert the water stream to a selected angle to thereby inhibit forward propulsion of the personal water craft; and quick release means for releasably securing the thrust diverter and personal water craft together with the intake end of the thrust diverter positioned to receive thrust from the discharge nozzle, and for selective operation to release the thrust diverter from the personal water craft.

2. A race starting device for personal water craft as claimed by claim 1 further comprising;

a frame; and means mounting the thrust diverter to the frame for adjustment thereon to accommodate a different personal water craft.

3. A race starting device for personal water craft as claimed by claim 1 further comprising;

a buoyant housing mounting the thrust diverter.

4. A race starting device for personal water craft as claimed by claim 1 further comprising;

a non buoyant housing mounting the thrust diverter.

5. A race starting device for personal water craft as claimed by claim 1 wherein the quick release means is further comprised of:

latch means mounted to the personal water craft and thrust diverter and selectively movable between an open position wherein the water craft is disengaged from the thrust diverter, and a latched position wherein the thrust diverter is attached to the personal water craft against rearward movement thereon.

6. A race starting device for personal water craft as claimed by claim 1 wherein the quick release means is comprised of:

latch means on the thrust diverter and adapted to be mounted to the personal water craft, and selectively movable between an open position wherein the water craft is disengaged from the thrust diverter, and a latched position wherein the thrust diverter is attached to the personal water craft against rearward movement thereon; and means for biasing the latch means to (the) closed position.

7. A race starting device for personal water craft as claimed by claim 6 wherein the quick release means is further comprised of:

a foot actuated latch operator connected to the releasable latch means and being movable responsive to operation by a user's foot to release the latch to the closed position thereof.

8. A race starting device for personal water craft as claimed by claim 1 wherein the quick release means is further comprised of a clamp member mounted to the diverter for releasably receiving and clamping the diverter to the personal water craft; and a foot actuated release member on the clamp member operable by a user's foot to release the clamp member.

9. A race starting device for personal water craft as claimed by claim 1 wherein the thrust diverter is comprised of a tube with a first open end defining the intake end, and a second open end defining the discharge end of the thrust diverter.

10. A race starting device for personal water craft as claimed by claim 1 wherein the thrust diverter is comprised of a tube with a first open end defining the intake end, and a second open end defining the discharge end of the thrust diverter, and wherein the tube includes a bent section to deflect the stream of water laterally of the stream of water received from the personal water craft.

11. A race starting device for personal water craft as claimed by claim 1 wherein the thrust diverter is a tube, divided into an upwardly oriented section for deflecting a portion of the water stream upwardly, and a side section for deflecting a portion of the water stream substantially horizontally and transverse to the water stream received from the personal water craft.

12. A race starting device for personal water craft as claimed by claim 1 wherein the thrust diverter is a bent tube and wherein the discharge end of the thrust diverter is an open end of the tube oriented upwardly to direct thrust from the discharge nozzle in an upward direction.

13. A race starting device for personal water craft as claimed by claim 1 further comprising:

a frame; and an intake restrictor on the frame adapted to span at least a portion of the water intake on the hull of the personal water craft.

14. A race starting device for personal water craft as claimed by claim 1, further comprising:

a frame; and an apertured intake restrictor plate on the frame adapted to span at least a portion of the water intake on the hull of the personal water craft with apertures sized to limit the amount of water received by the water intake of the personal water craft.

15. A race starting device for personal water craft as claimed by claim 1 wherein the diverter includes paired side discharges oriented substantially horizontally and transversely to the water stream.

16. A race starting device for personal water craft as claimed by claim 1 wherein the diverter includes paired side discharges oriented substantially transversely to the water stream and substantially horizontally, and further comprising;

caps covering the paired side discharges with openings therein for releasing water received through the diverter, the caps being angularly adjustable on the side discharges to permit selective angular adjustment of water released through the openings.

17. A race starting device for personal water craft as claimed by claim 1, further comprising a hollow housing on the thrust diverter with openings therein to permit the housing to fill with water.

18. A race starting device for personal water craft as claimed by claim 1, further comprising a plurality of said thrust diverters and quick release means; and a group starting frame mounting the thrust diverters and quick release means in an aligned starting line configuration.

19. A race starting device for personal water craft as claimed by claim 1, further comprising:

a plurality of said thrust diverters and quick release means;

a group starting frame mounting the thrust diverters and quick release means in an aligned starting line configuration; and wherein each quick release means includes an operator controlled quick release means for individual selective control.

20. A race starting device for personal water craft as claimed by claim 1, further comprising:

a plurality of said thrust diverters and quick release means;

a group starting frame mounting the thrust diverters and quick release means in an aligned starting line configuration; and a common release means connected to the quick release means for selective operation to release all said quick release means simultaneously.

* * * * *